US005487547A

United States Patent [19]

Hobert

[11] Patent Number: 5,487,547

[45] Date of Patent: Jan. 30, 1996

[54] CRAPS LAYOUT ARRANGEMENT HAVING JACKPOT AREA

[76] Inventor: Marcus V. Hobert, 3318 Kenwood Ave., Davenport, Iowa 52807

[21] Appl. No.: 305,178

[22] Filed: Sep. 13, 1994

[51] Int. Cl.[6] ..... A63F 9/04

[52] U.S. Cl. ..... 273/274

[58] Field of Search ..... 273/274, 309, 273/146

[56] References Cited

U.S. PATENT DOCUMENTS

| | | | |
|---|---|---|---|
| 3,399,897 | 9/1968 | Mitchell | 273/146 |
| 3,904,208 | 9/1975 | Grossman | 273/146 |
| 4,334,685 | 6/1982 | Robbins et al. | 273/274 |
| 4,688,803 | 8/1987 | Ollington | 273/274 |
| 4,900,034 | 2/1990 | Bereuter | 273/274 |
| 4,902,019 | 2/1990 | Berman | 273/256 |
| 5,133,559 | 7/1992 | Page | 273/274 |
| 5,308,081 | 5/1994 | Bartle | 273/274 |
| 5,350,175 | 9/1994 | DiLullo et al. | 273/274 |

*Primary Examiner*—Benjamin H. Layno
*Attorney, Agent, or Firm*—McAndrews, Held & Malloy, Ltd.

[57] ABSTRACT

The present invention relates to a craps gaming layout arrangement which permits the game of craps to be played in a conventional manner while simultaneously introducing a jackpot into the game.

29 Claims, 4 Drawing Sheets

CRAPS LAYOUT ARRANGEMENT HAVING JACKPOT AREA

BACKGROUND OF THE INVENTION

The present invention relates to a gaming layout having a jackpot area and more particularly to a Craps gaming layout arrangement which permits the game of Craps to be played in a conventional manner while simultaneously introducing a jackpot into the game.

The magical allure of being able to "Hit The Jackpot" has always held special fascination for the populous as a whole. Typically, an extremely large payoff or jackpot is available as part of a basic wager so that the mere possibility of the jackpot is relied upon as a lodestone to attract consumer interest in such gaming devices as, for example, slot machines.

In states such as Nevada and New Jersey which have legalized gambling, competition among casinos and the like in attracting clientele to gaming establishments has always been quite fierce. Such competition has generally proceeded in terms of the magnificence of the establishment, incentives provided to patrons, and, to a limited extent, jackpots made available through specialized gaming devices such as slot machines or by special rules arranged to apply to a large number of simultaneous games, such as in tournaments. However, the ability to compete in terms of the magnificence of the establishment and incentives provided to patrons quickly becomes saturated due to practical considerations.

Jackpots provided as the sole payoff on specialized gaming devices do not present an effective or a continued attraction to patrons. This occurs since regular patrons of such establishments will generally not continue to be attracted to a gaming device whose sole ability is to provide a jackpot since the odds associated therewith are inordinately high and these devices do not otherwise provide patron satisfaction.

Heretofore, the ability to inject the aura of a jackpot into conventional gaming equipment has been highly limited. This has resulted since conventional gaming arrangements cannot be provided with the possibility of winning a jackpot without a major modification of the game arrangement and in fact a changing of the way or rules by which the conventional game is played. This is objectionable since only traditional forms of gaming have wide appeal to patrons.

In addition, jackpot arrangements which occur as a result of conditions which do not involve the patron have always been somewhat suspect and not well received by the public. For example, U.S. Pat. No. 4,902,019 issued to Berman discloses the use of jackpot areas in the game of Craps wherein the jackpot areas are defined by a geometric shape embossed on the Craps table. A jackpot condition is attained when a die rebounds off the dice table wall and lands completely inside the geometric shape. The question arises as to whether the player rolling the dice is playing craps or is rather attempting his skill at putting a die in the geometric shape. This destroys or changes the atmosphere of the conventional game of craps being played. Also, the jackpot condition involved in Berman does not depend on any additional wagering possibilities related to the various dice outcomes in the game of Craps.

Accordingly, it is a principal object of the present invention to provide a gaming layout arrangement for the game of Craps which includes a jackpot condition dependent on additional wagering events related to the various dice outcomes in the game of Craps.

It is a further object of this invention to provide a gaming layout arrangement for the game of Craps that permits the game of Craps to be played in the conventional manner while providing without game interference the additional availability of a jackpot. An additional object of this invention is to provide a gaming layout arrangement for the game of Craps that permits a player to wager on jackpot possibilities corresponding to a high payoff.

A further object is to provide a gaming layout arrangement for the game of Craps including a jackpot wherein the jackpot condition is attained by rolling a pre-defined series of dice outcomes.

Other objects and advantages of the present invention will become apparent from the following more detailed description, which, in conjunction with the accompanying drawings, illustrates, by way of example, the principles of the invention.

SUMMARY OF THE INVENTION

The foregoing objects and advantages are accomplished by a gaming layout for the game of Craps having a jackpot box for receiving a wager that a set of predefined dice outcomes is rolled. The set of predefined dice outcomes has a remote probability of occurrence. A jackpot corresponds to a higher payoff than the payoffs associated with the ongoing possibilities of a conventional Craps game.

BRIEF DESCRIPTION OF THE DRAWINGS

The preferred embodiment of the present invention is shown in the attached drawings, in which.

DETAILED DESCRIPTION OF THE INVENTION

Figure 1:
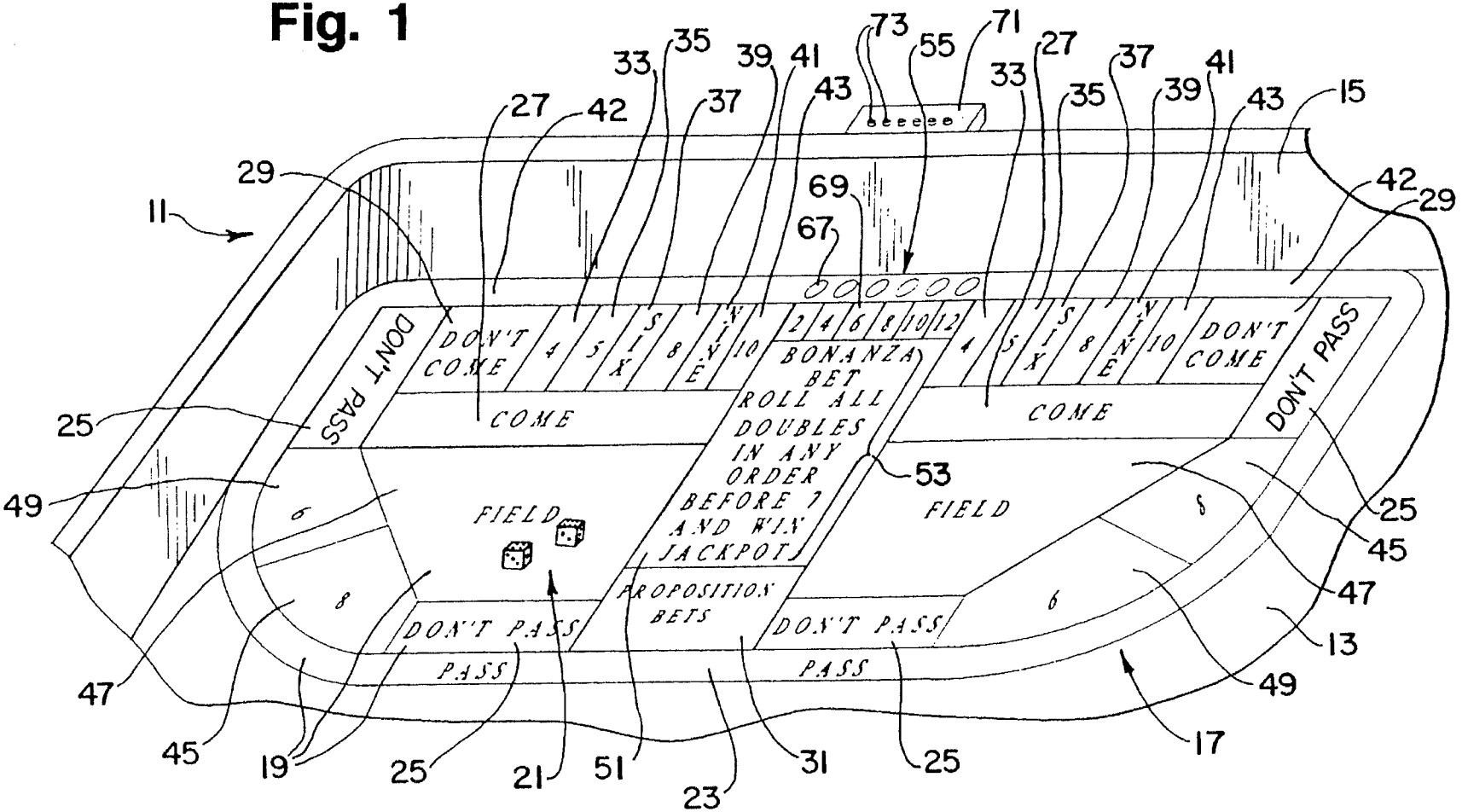
FIG. 1 is a perspective view of an embodiment of a Craps gaming layout arrangement having a jackpot wagering area, according to the present invention.

Referring to FIG. 1, the game of Craps is played on a gaming structure 11 which includes a flat table surface 13 and a side wall 15 that circumscribes fully or partially flat surface 13. A craps layout 17 is printed on flat surface 13 to provide a plurality of separate wager areas 19.

A single player, known as a shooter, rolls dice 21 (two die are rolled simultaneously) in order to determine the win/lose outcome of wagers placed on Craps layout 17. The wagers may be placed by the shooter and any number of other players. The wagers are placed by a player positioning chips or money within any one of a number of wager areas 19. On some occasions, a player may hand the chips to a dealer and tell the dealer what wager the player wishes to make.

The outcome of the roll of dice 21 is based on the sum of the spots on the two sides of the dice which face up when the dice come to rest. The shooter rolls the dice on flat surface 13 and the dice may hit against side wall 15 before coming to rest. The outcome of the roll of the dice is compared to the wagers to determine the win/lose of each wager. Some wagers require a number of rolls of the dice, whereas other wagers are made with respect to the next roll.

The game is organized with three different groupings of outcome numbers: the naturals (7 and 11), the craps (2, 3, and 12), and the point numbers (4, 5, 6, 8, 9, and 10).

The play of a game begins with an initial dice roll by the shooter. This initial roll is called the "come out roll." The shooter will repeatedly roll the dice until a point number is rolled. Once the point number is determined, the shooter will continue to roll the dice until that point number is rolled once again or a 7 is rolled.

The players, including the shooter, may place wagers betting that the point number will be rolled before the 7 is rolled by placing a wager within the "pass line" area 23. As shown in FIG. 1, a label comprising the word "PASS" is printed within area 21 to identify the wager area type. The players may also place wagers betting that the 7 will be rolled before the point number is rolled by placing a wager within the "DON'T PASS" area 25. As shown in FIG. 1, there are four "don't pass" areas 25. A label comprising the words "DON'T PASS" is printed within each area 25 to identify the wager area type.

The PASS area 23 and the DON'T PASS areas 25 are also used for wagers during the come out roll prior to the point number being established by the shooter. Until a point number is established, the pass line wager is a bet that the shooter will roll a natural before a point number or before craps is rolled. Also, until a point number is established, the "don't pass" wager is a bet that the shooter will roll craps before a point number or before a natural is rolled, except that a roll of 2 or 12, as predetermined by the host of the game, is treated as a tie.

After the point number is established, the craps numbers and 11 have no bearing on the outcome of the "pass" and "don't pass" wagers until after a 7 or the point number again is rolled. If a 7 is rolled, the pass line bets lose, the don't pass bets win, the shooter's turn is over, and the dice are given to another player to become the shooter. If the point number is repeated, the pass line bets win, the don't pass bets lose, and the shooter starts over with a new "come out roll."

In addition to making wagers in the PASS and DON'T PASS areas 23, 25, a player may also make similar wagers with respect to subsequent rolls of the dice, with essentially the same outcomes. These wagers are called "come" and "don't come" bets. The wagers are placed in a COME area 27 and a DON'T COME area 29.

After the point number is established on the "come out" roll or rolls, the players, including the shooter, may place wagers that another point number will be established and rolled again before the 7 is rolled by placing a wager within the "come" area 27. For example, after a first point number of 6 is established, the shooter's next roll is a second point number of 8. Then the shooter's following roll is another 8. Thus, the "come" wager wins. Also, until another point number is established, the "come" wager is a bet that the shooter will roll a natural before a point number or before Craps is rolled.

Also, after the first point number is established, the players may place wagers betting that another point number will be established but that the number 7 will be rolled before the point number is rolled again by placing a wager within the "don't come" area 29. Likewise, until another point number is established, the "don't come" wager is a bet that the shooter will roll craps before a point number or before a natural is rolled, except that a roll of 2 or 12, as predetermined by the host, is treated as a tie.

After a second point number is established, the Craps numbers and 11 have no bearing on the outcome of the "come" or "don't come" wagers made on prior rolls until a 7 or that point number again is rolled. If a 7 is rolled, the come bets lose and the don't come bets win. If the point number is repeated, the come bets win and the don't come bets lose. After the "come out" roll or rolls, "come" and "don't come" wagers may be made on every subsequent roll until the 7 or the initial point number again is rolled.

There are also a group of wagers in which the players may bet that the next roll or rolls of the dice will produce a certain number by the appearance of identical faces on each die ("doubles") before a 7 is rolled. Commonly called "hard-way" bets, these wagers are also called proposition bets and are placed in area 31.

There are wagers in which players may bet that the numbers 6 or 8 will appear on the dice before the number 7 is rolled. These wagers are called the "Big 6" and the "Big 8" bets, respectively and are placed in areas 49 and 45, respectively.

The point numbers determined for the "come" and "don't come" wagers are monitored by placing "come" and "don't come" bets directly on areas 33, 35, 37, 39, 41, and 43, which are the point number boxes. Wagers called "place" bets that these numbers will appear on the dice before the number 7 is rolled also may be placed directly on the respective point number boxes. Wagers called "Lay" bets that these numbers will not appear on the dice before the number 7 is rolled also may be placed behind the respective point number boxes, in area 42.

The "Field" bet is also a single roll bet that one of a group of numbers will appear on the next roll of the dice. These wagers are placed in areas 47.

Although players may generally place as many bets or combinations of bets on any roll of the dice as they wish, the game of Craps as it is currently played does not offer the player a single bet which allows the player to receive a high-multiple payoff of the player's wager. The highest payoff of 30 to 1 on contemporary layouts are for the proposition bets that the next roll of the dice will total 2 or 12. Other than the proposition bets, the wagers available to players do not exceed a 2-to-1 payoff.

Figure 2:
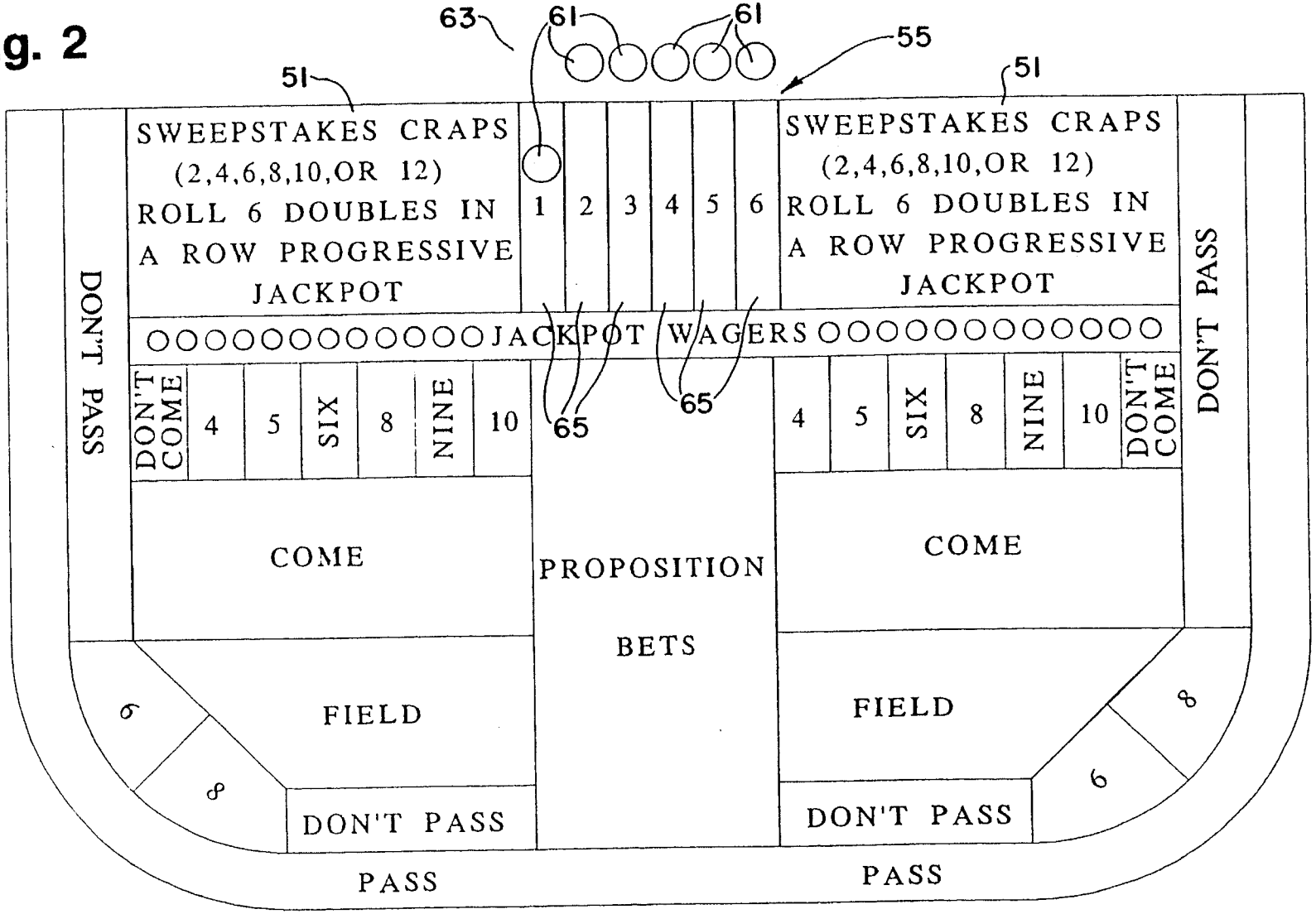
FIG. 2 is a top plan view of a second embodiment of a Craps gaming layout arrangement having a jackpot wagering area.

As shown in FIG. 1, a separate jackpot wagering area 51 is included for wagering on a particular jackpot possibility. The jackpot wagering area 51 is centrally located in FIG. 1 on the Craps layout 17, for example, "above" the PROPOSITION BETS area 31 in the central third of the layout. As will suggest itself, jackpot wagering area 51 may be positioned at a different location within the craps layout, as for example as shown in FIG. 2. The jackpot wagering area 51 is designated with a name or label 53 which indicates the nature of the wager. As shown in FIG. 1, label 53 indicates to the players that if all of the doubles are rolled in any order before a 7 is rolled, the jackpot is won. In addition, a title for the bet, BONANZA BET, is shown by label 53. Various other applicable titles may be used such as "JACKPOT", "SUPER CRAPS JACKPOT", "BONANZA CRAPS", "BONUS BET", or "SWEEPSTAKES CRAPS."

Thus, the jackpot wager of FIG. 1 is won when the shooter completes a series of predefined numbers or sums of numbers on the dice. In the FIG. 1 embodiment, the series of numbers are 2, 4, 6, 8, 10, 12, rolled in any order, and as such is sufficiently remote in probability to justify a high-multiple payoff.

There are seven types of events which a host of the game could designate as the series to be completed. These series of events are:

(a) rolling all ten other numbers before a seven is rolled; (A variation of this is to roll all ten other numbers and then roll a 7.)

(b) rolling a predetermined number of consecutive "doubles" (the same number appearing on each die) before a seven is rolled; (A variation of this is to roll the predetermined number of doubles and then roll a 7.)

(c) rolling a predetermined number of consecutive identical sums of numbers (such as five consecutive 12's) before a 7 is rolled; (A variation of this is to roll the predetermined number of consecutive identical sums of numbers and then roll a 7.) (Another version is to roll a predetermined number of consecutive identical sums of 7.)

(d) rolling a predetermined series of consecutive sequential numbers (such as a 2 followed by a 3 followed by a 4 followed by a 5 followed by a 6) before a 7 is rolled; (A variation of this is to roll the predetermined series of consecutive sequential numbers and then roll a 7.)

(e) rolling all possible double combinations (two ones totaling 2, two twos totaling 4, two threes totaling 6, two fours totaling 8, two fives totaling 10, and two sixes totaling 12) before a 7 is rolled; (A variation of this is to roll all of the doubles and then roll a 7.)

(f) rolling a predetermined number of consecutive natural numbers; (7 and 11)

(g) rolling a predetermined number of consecutive craps numbers (2, 3, 12) before a seven is rolled; (A variation of this is to roll the predetermined series of consecutive Craps numbers and then roll a seven.)

(h) rolling all of the field numbers (2, 3, 4, 9, 10, 11, and 12) before a seven is rolled; (A variation of this is to roll all field numbers and then roll a 7.); and (i) rolling any sort of numbers as predetermined by the host either before a 7 is rolled or in a series ending with a 7.

Figure 3:
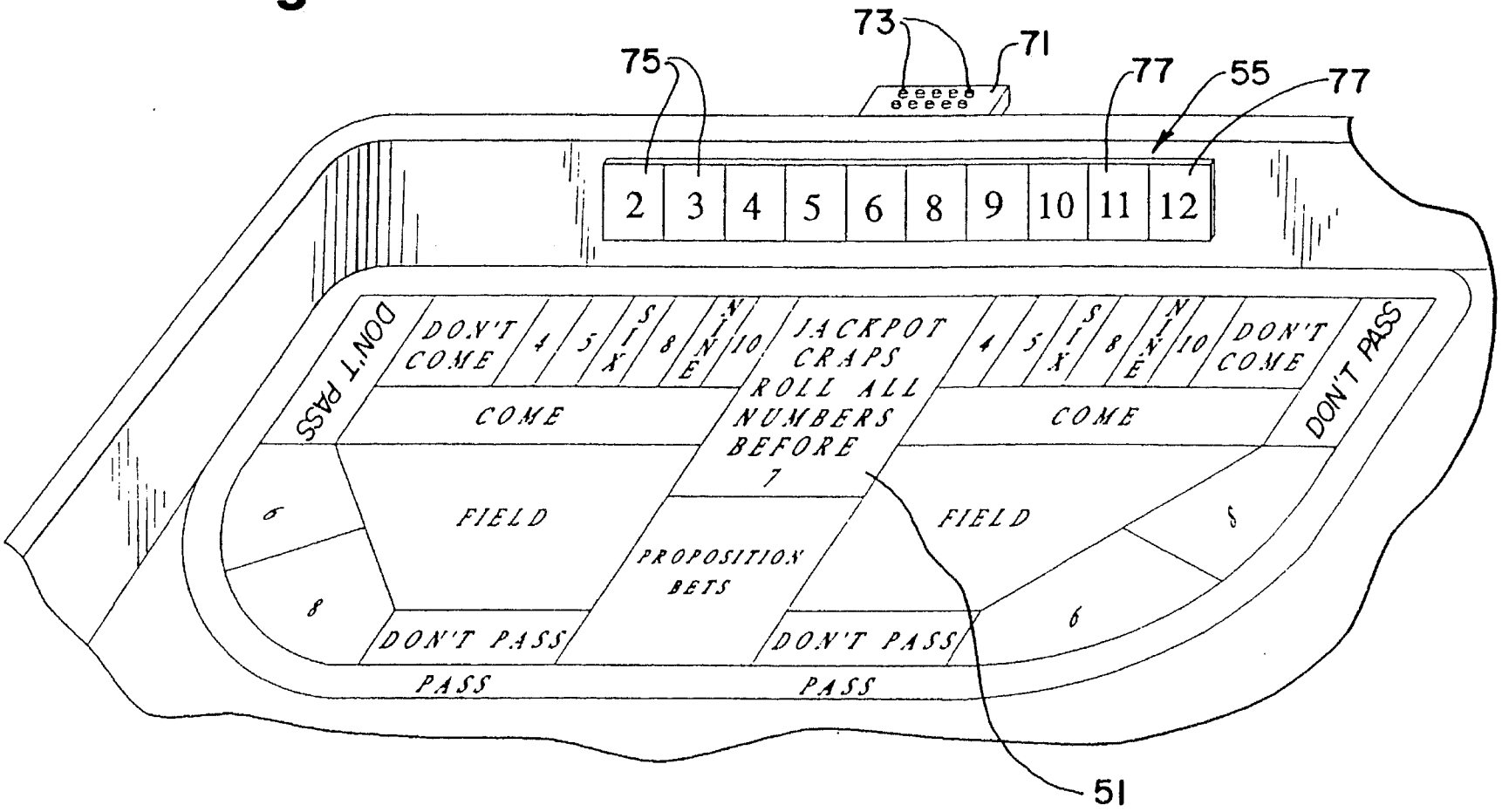
FIG. 3 is a perspective view of a third embodiment of a Craps gaming layout arrangement having a jackpot wagering area.
Figure 4:
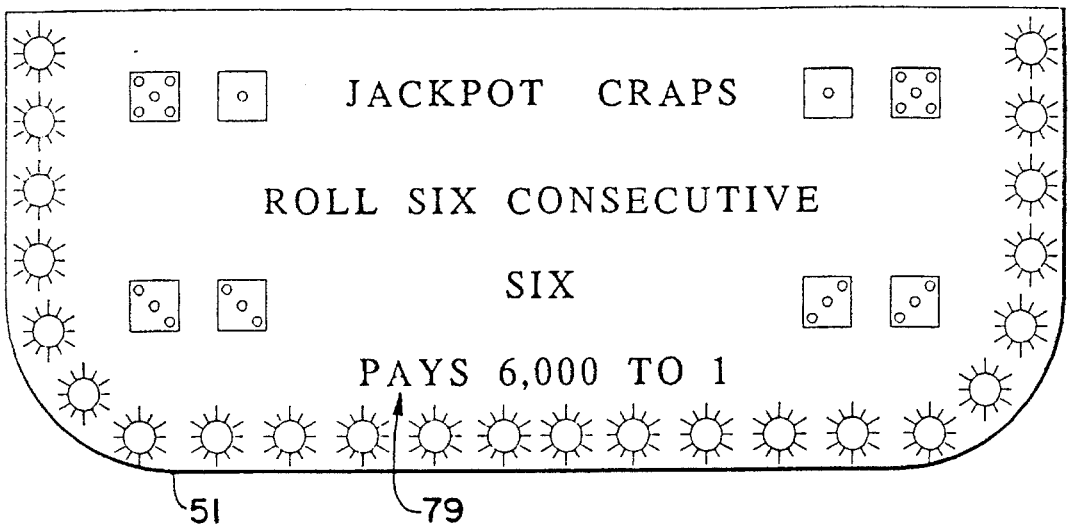
FIG. 4 is a top plan view of a jackpot wagering area.
Figure 5:
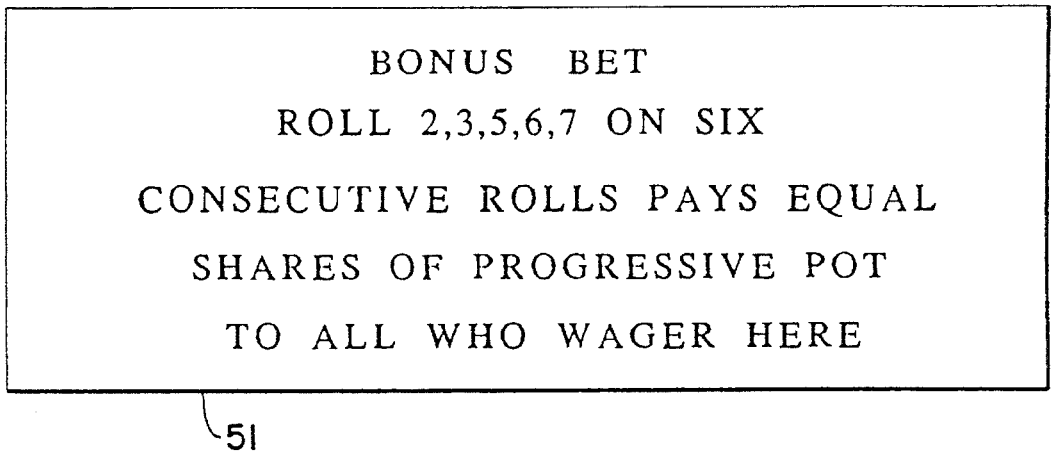
FIG. 5 is a top plan view of a jackpot wagering area.
Figure 6:
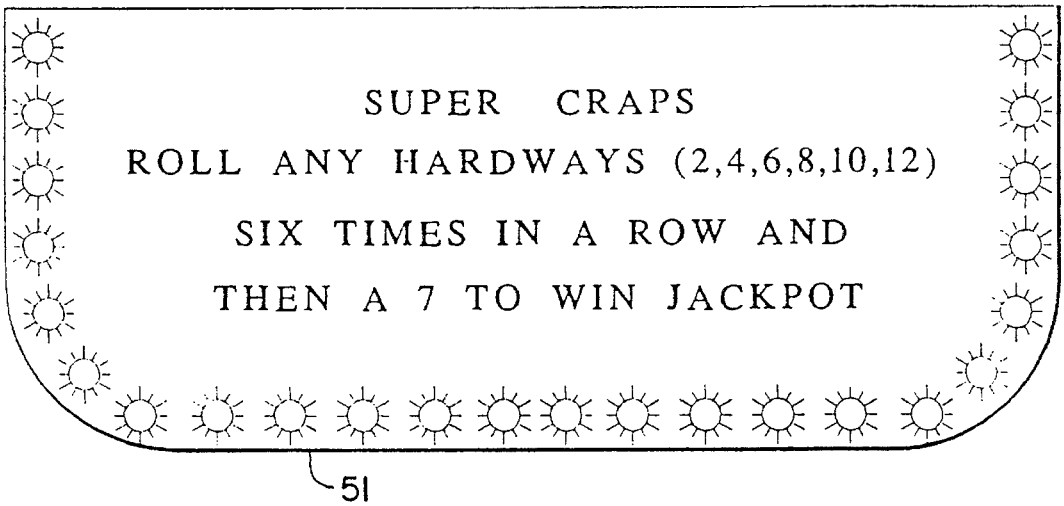
FIG. 6 is a top plan view of a jackpot wagering area.

As shown in FIG. 2, the series of events associated with jackpot wagering area 51 is the roll of six doubles (2, 4, 6, 8, 10, 12) in a row before a 7 is rolled. As shown in FIG. 3, the series of events associated with jackpot wagering area 51 is the roll of ten numbers (2, 3, 4, 5, 6, 8, 9, 10, 11, 12) before a 7 is rolled. As shown in FIG. 4, the series of events associated with jackpot wagering area 51 is the roll of six consecutive 6s. As shown in FIG. 5, the series of events associated with jackpot wagering area 51 is the consecutive rolls of six numbers (2, 3, 4, 5, 6, 7). As shown in FIG. 6, the series of events associated with jackpot wagering area 51 is the roll of any one of a group of numbers (2, 4, 6, 8, 10, 12) five times in a row.

A player makes a jackpot bet as follows. On the first come out roll of the shooter, a player will make a wager. For example, a player will place a $1.00 chip in jackpot area 51 of FIG. Visual indicia 79 is printed in area 51 to indicate that the jackpot pays 6,000 to 1. Thus, a bet of $10.00 will yield $60,000 on a jackpot win.

The host establishes the time at which bets may be placed, but typically the bet is required to be placed before the first outcome roll which begins the series leading to a jackpot win. The host must also keep track of which players make wager in the jackpot area 51. In addition, the host sets the minimum and maximum bet permitted for jackpot area 51.

Rather than indicia 79 stating the wager odds of "6,000 to 1", indicia 79 may state a fixed dollar amount payoff, for example, $20,000. In such a case, all players who wager in the jackpot area will each share in a single jackpot amount.

Alternative, the jackpot may be a progressive jackpot, i.e., a jackpot which starts at a minimum dollar amount and is progressively increased. The pot is increased by a percentage of the wagers lost in the jackpot area. The host will set the proportionate increase of the jackpot for wagers placed. For example, the host could establish that the jackpot increases 50 cents for each dollar wagered and lost in the jackpot area.

The host may calculate the progressive jackpot based upon wagers made at a single table or based upon wagers made at a group of tables in which craps games are being simultaneously played. A jackpot winner at one table serves to reset the jackpot value to its minimum at all tables in the group.

The host may make the jackpot easier or more difficult to achieve by varying the definition of the qualifying series of required outcomes. For example, three doubles/hardways in a row is easier to win than four doubles/hardways in a row. The payoff may also be varied according to the difficulty of achieving the defined series of sequence. For example, instead of paying 6000 to 1, an easier series may pay 4000 to 1.

The host of the game may require the completion of the series before any seven is rolled, including on come out rolls in order to qualify for a jackpot payoff. In addition, the host may require that the series be completed before the shooter does not pass, but not counting any come out roll either for or against satisfaction of the requirement for winning the jackpot. This requires the shooter to make the specific outcome rolls of the jackpot within the shooter's turn at rolling the dice.

The host may decide when the jackpot wager is lost. For example, when the shooter does not complete the series before the end of the shooter's turn, i.e., does not pass, then the bet is lost. Alternatively, when a consecutive sequence is not completed, once the sequence has started, the bet is lost. Also, a timer (not shown) may be set to provide a period of time within which the jackpot conditions must be met; at the end of the timer period, the bet is lost.

The host will also set the value of the high-multiple payoff for the jackpot wager. The payoff could be a fixed payoff at some rate less than the true odds of the series of events selected by the host to define how the jackpot may be won, such as 1,000 to 1 or 5,000 to 1. The payoff may also be defined as a progressive jackpot consistent with the manner in which progressive jackpots are currently computed within the gambling entertainment industry. Since a large number of players may be placing the jackpot wager on any shooter, the precise payoff for each player could not be predetermined, since each player with a wager would receive a prorated share of the progressive jackpot. The host could set a minimum payoff for any winning jackpot wager.

Referring again to FIG. 1, a display area 55 is comprised of six separately actuatable displays 67 and six visual indicia 69, for displaying the progress of the dice roller in completing the required series of rolls in order to win the jackpot. In FIG. 1, there are six such displays 67 and indicia 69 because the host has defined the jackpot as a series of six qualifying rolls. The actual number of displays and indicia are a function of the manner in which the host has defined the jackpot sequence. For example, in FIG. 3, ten displays and indicia are used, as described hereinafter.

As shown in FIG. 1, the display area 55 is immediately adjacent to the jackpot wager area 51 on the layout. Each of the six displays 67 are located adjacent to one of the six visual indicia 69 which comprise the six numbers 2, 4, 6, 8, 10, 12. Each display 67 is actuatable to occupy one of two states, ON or OFF, by a visual change in display 67, for example, by lighting the display 67 with light. Display 67 indicates when ON that its adjacently associated visual indicia 69 is met, i.e., the number identified by the visual indicia 69 adjacent to the ON display has been rolled by the shooter. This provides a visual disclosure to the players of the closeness of the shooter in making the jackpot requirements.

In the alternative, the display area 55 may show the numbers and sums of numbers to be rolled for a payoff and indicate which numbers are to be rolled or have been rolled by a different type of indicator light. The lights may be lightbulbs (not shown) with the numbers or sums of numbers appearing on the bulbs themselves or the lightbulbs may be located immediately above, below, or beside the numbers or sums of numbers, or the lights may be in the shape of the numbers to be rolled. The lights may be turned ON continuously or flashed to indicate an ON condition. As shown in FIG. 1, the six displays 67 may be separately lit to indicate an ON condition. As the dice roller rolls a particular number or sum of numbers, the lightbulbs may progressively be turned OFF or ON, so that the displays 67 report on the progress of the dice roller toward meeting the jackpot requirements.

Alternatively, display area 55 may be located in a separate part of the layout. Alternatively, the display area 55 may be separated from the layout in a form by which the progress of the dice roller is visually disclosed to the players. The display area 55 may chart the progress of the dice roller by showing all of the necessary numbers or sums of numbers which must be rolled in the jackpot series and indicating the progress of the dice roller in achieving the roll of those numbers or groups of numbers. The display area 55 may either indicate which numbers or sums of numbers have already been rolled or which numbers or sums of numbers remain to be rolled.

Referring again to FIG. 1, a control board 71 is secured to side wall 15 and comprises six separate switches 73 which are manually actuatable to light (or turn ON) a respective display 67. The host of the game will supervise operation of control board 71.

As shown in FIG. 2, the display area 53 may include manual markers 61 (similar in shape to a cylindrical puck) to cover (or uncover) indicia identifying the numbers or sums of numbers as they are rolled. An area 63 on flat surface 13 may be provided for locating markers 61 and from which the markers 61 are moved to cover visual indicia in areas 65. The visual indicia are the numerals 1, 2, 3, 4, 5, 6, as shown, and are each of a size to be coverable by a single marker 61.

Referring to FIG. 3, display area 55 includes ten separately lightable frames 75. Frames 75 are translucent, light permeable, square plates with an indicia 77 located in each frame 75. An indicia 77 of each frame identifies a dice outcome number which has been rolled, when its respective frame 75 is lit. A frame 75 is lit, or turned ON, by activation of a lightbulb (not shown) located behind the frame. Each switch 73 controls activation of a frame 75.

While only a single, preferred embodiment of the invention has been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. An amusement device including:

a pair of dice each having six faces bearing a visual representation of the numbers one through six, said dice being of a size for manually rolling to present one of eleven different numbers which define a plurality of point numbers, at least one natural number, and at least one craps number;

a game layout to provide a flat surface upon which said dice may be rolled and upon which bets may be laid by physical placement of wagers, said flat surface including indicia thereon representing a plurality of wager areas, said wager areas including:

(a) a pass line area for receiving a wager betting both (i) that one or more rolls of dice will yield an established first point number without rolling the number "7"; and (ii) that a natural number is rolled prior to establishing the first point number or prior to rolling a craps number;

(b) a don't pass area for receiving a wager betting both (i) that one or more rolls of the dice will yield the number "7" prior to the rolling of an established first point number; and (ii) that a craps number is rolled prior to establishing the first point number or prior to rolling a natural number;

(c) a come area for receiving a wager betting both (i) that one or more rolls will yield an established subsequent point number without rolling the number "7"; and (ii) that a natural number is rolled prior to establishing the subsequent point number or prior to rolling a craps number;

(d) a don't come area for receiving a wager betting both (i) that one or more rolls will yield the number "7" prior to the rolling of an established subsequent point number; and (ii) that a craps number is rolled prior to establishing the subsequent point number or prior to rolling a natural number;

(e) a jackpot area for receiving a wager that a set of a plurality of dice outcomes are rolled, said set having a remote probability of occurrence.

2. An amusement device comprising:

a pair of dice each having six faces bearing a visual representation of the numbers one through six, said dice being of a size for manually rolling to present one of eleven different numbers which define a plurality of point numbers, at least one natural number, and at least one craps number;

a game layout to provide a flat surface upon which said dice may be rolled and upon which bets may be laid by physical placement of wagers, said flat surface including indicia thereon representing a plurality of wager areas, said wager areas including:

(a) a pass line area for receiving a wager betting both (i) that one or more rolls of dice will yield an established first point number without rolling the number "7"; and (ii) that a natural number is rolled prior to establishing the first point number or prior to rolling a craps number;

(b) a don't pass area for receiving a wager betting both
(i) that one or more rolls of the dice will yield the number "7" prior to the rolling of an established first point number; and
(ii) that a craps number is rolled prior to establishing the first point number or prior to rolling a natural number; and
(c) a jackpot area for receiving a wager that a set of a plurality of dice outcomes are rolled, said set having a remote probability of occurrence.

3. An amusement device according to claim 2 wherein said set of a plurality of dice outcomes is predetermined.

4. An amusement device according to claim 2 and further including a jackpot display selectively actuatable to provide a visual indication of dice outcomes of said set.

5. An amusement device according to claim 4 wherein said jackpot display includes a plurality of separate indicators, each of said indicators indicating one of said dice outcomes of said set.

6. An amusement device according to claim 5 wherein each of said indicators has an ON condition and an OFF condition.

7. An amusement device according to claim 2 wherein said jackpot area includes visual indicia indicating said set of dice outcomes.

8. An amendment device according to claim 2 wherein said jackpot area is available to all players for wagers.

9. An amusement device according to claim 2 and further including a jackpot which is shared among all players wagering in said jackpot area.

10. An amusement device according to claim wherein said jackpot display area includes means for displaying the progress made toward winning said jackpot.

11. An amusement device according to claim 10 wherein said means for displaying said progress comprises a marker, and separate indicia of each one of said outcomes, said marker useable to mark one of said indicia.

12. An amusement device according to claim 10 wherein said means for displaying said progress includes a lighting mechanism for separately indicating each one of said dice outcomes.

13. An amusement device according to claim 12 wherein said means for displaying said progress includes separate indicia of each one of said outcomes, said lighting mechanism separately highlighting each of said separate indicia.

14. The gaming layout according to claim 2 wherein said series of dice outcomes comprises a plurality of consecutive, equivalent dice outcomes of any of the numbers 2, 3, 4, 5, 6, 8, 9, 10, 11, or 12, followed by a 7.

15. The gaming layout according to claim 2 wherein said series of dice outcomes comprises consecutive dice outcomes of numbers in sequence, followed by a 7.

16. The gaming layout according to claim 2 wherein said series of dice outcomes comprises a plurality of consecutive dice outcomes of any one of 2, 4, 6, 8, 10, or 12, followed by a 7.

17. The gaming layout according to claim 2 wherein said series of dice outcomes comprises dice sums of 2, 4, 6, 8, 10, and 12, in any order, followed by a 7.

18. The gaming layout according to claim 2 wherein said series of dice outcomes comprises dice outcomes of any of the numbers 2, 3, 4, 5, 6, 8, 9, 10, 11, and 12, in any order, followed by a 7.

19. The gaming layout according to claim 2 wherein said series of dice outcomes comprises a plurality of consecutive, equivalent dice outcomes of 2, 3, 4, 5, 6, 8, 9, 10, 11, or 12, before a 7 is rolled.

20. The gaming layout according to claim 2 wherein said series of dice outcomes comprises consecutive dice outcomes of numbers in sequence, before a 7 is rolled.

21. The gaming layout according to claim 2 wherein said series of dice outcomes comprises a plurality of consecutive dice outcomes of any one of 2, 4, 6, 8, 10, or 12, before a 7 is rolled.

22. The gaming layout according to claim 2 wherein said series of dice outcomes comprises dice outcomes of 2, 4, 6, 8, 10, and 12, before a sum of 7 is rolled.

23. The gaming layout according to claim 2 wherein said series of dice outcomes comprises dice outcomes of 2, 3, 4, 5, 6, 8, 9, 10, 11, and 12, in any order, before a 7 is rolled.

24. The gaming layout according to claim 2 wherein said series of dice outcomes comprises a plurality of consecutive dice outcomes of the number 7.

25. The gaming layout according to claim 2 wherein said series of dice outcomes comprises a plurality of consecutive dice outcomes of the natural numbers 7 and 11 in any order.

26. The gaming layout according to claim 2 wherein said series of dice outcomes comprises a plurality of consecutive dice outcomes of the craps numbers 2, 3, and 12 in any order.

27. The gaming layout according to claim 2 wherein said series of dice outcomes comprises a plurality of consecutive dice outcomes of the craps numbers 2, 3, and 12, followed by a 7.

28. The gaming layout according to claim 2 wherein said series of dice outcomes comprise a plurality of dice outcomes of the field numbers (two, three, four, nine, ten, eleven and twelve) before a seven is rolled.

29. The gaming layout according to claim 2 wherein said series of dice outcomes comprises a plurality of dice outcomes of a set of numbers as predetermined by the host before a seven is rolled.

* * * * *